US007239195B1

(12) United States Patent
Dhanasekaran

(10) Patent No.: US 7,239,195 B1
(45) Date of Patent: Jul. 3, 2007

(54) ACTIVE POWER SUPPLY REJECTION USING NEGATIVE CURRENT GENERATION LOOP FEEDBACK

(75) Inventor: Vijayakumar Dhanasekaran, Bryan, TX (US)

(73) Assignee: Intersil Americas, Inc., Milpitas, CA (US)

( * ) Notice: Subject to any disclaimer, the term of this patent is extended or adjusted under 35 U.S.C. 154(b) by 134 days.

(21) Appl. No.: 11/227,363

(22) Filed: Sep. 15, 2005

Related U.S. Application Data

(60) Provisional application No. 60/614,636, filed on Sep. 30, 2004.

(51) Int. Cl.
*G05F 1/10* (2006.01)

(52) U.S. Cl. ..... 327/538; 327/560

(58) Field of Classification Search ..... 327/535, 327/537, 538, 543, 560, 561, 562, 563
See application file for complete search history.

(56) References Cited

U.S. PATENT DOCUMENTS 5,162,668 A 11/1992 Chen et al.
5,818,295 A * 10/1998 Chimura et al. ..... 327/561
5,936,460 A 8/1999 Iravani
6,492,796 B1 12/2002 Morley
6,586,987 B2 7/2003 Somerville et al.

OTHER PUBLICATIONS

Siew Kuok Hoon; Jun Chen; Maloberti, F., "An improved bandgap reference with high power supply rejection", Circuits and Systems, 2002. ISCAS 2002. IEEE International Symposium on, vol. 5, May 26-29, 2002.
Michael W. Baker, Rahul Sarpeshkar, "A Low-Power High-PSRR Current-Mode Microphone Preamplifier" IEEE JSSC vol. 38 No. 10 Oct. 2003.

* cited by examiner

*Primary Examiner*—Jeffrey Zweizig
(74) *Attorney, Agent, or Firm*—Gary R. Stanford

(57) ABSTRACT

A negative current generator for an amplifier circuit including a shunt transistor, first and second mirror transistors, a current bias device, and an amplifier. The amplifier circuit includes a current source transistor having current terminals coupled between a supply terminal and an input node and a control terminal receiving a bias voltage. The shunt transistor is coupled in a shunt configuration with the current source transistor. Each mirror transistor has a control terminal, a first current terminal coupled to the supply terminal and a second terminal coupled to a voltage node. The control terminal of the first mirror transistor receives another bias voltage. The current bias device draws a constant current from the voltage node. The amplifier has a first input receiving a reference voltage, a second input coupled to the voltage node, and an output coupled to the control terminals of the shunt and second mirror transistors.

19 Claims, 1 Drawing Sheet

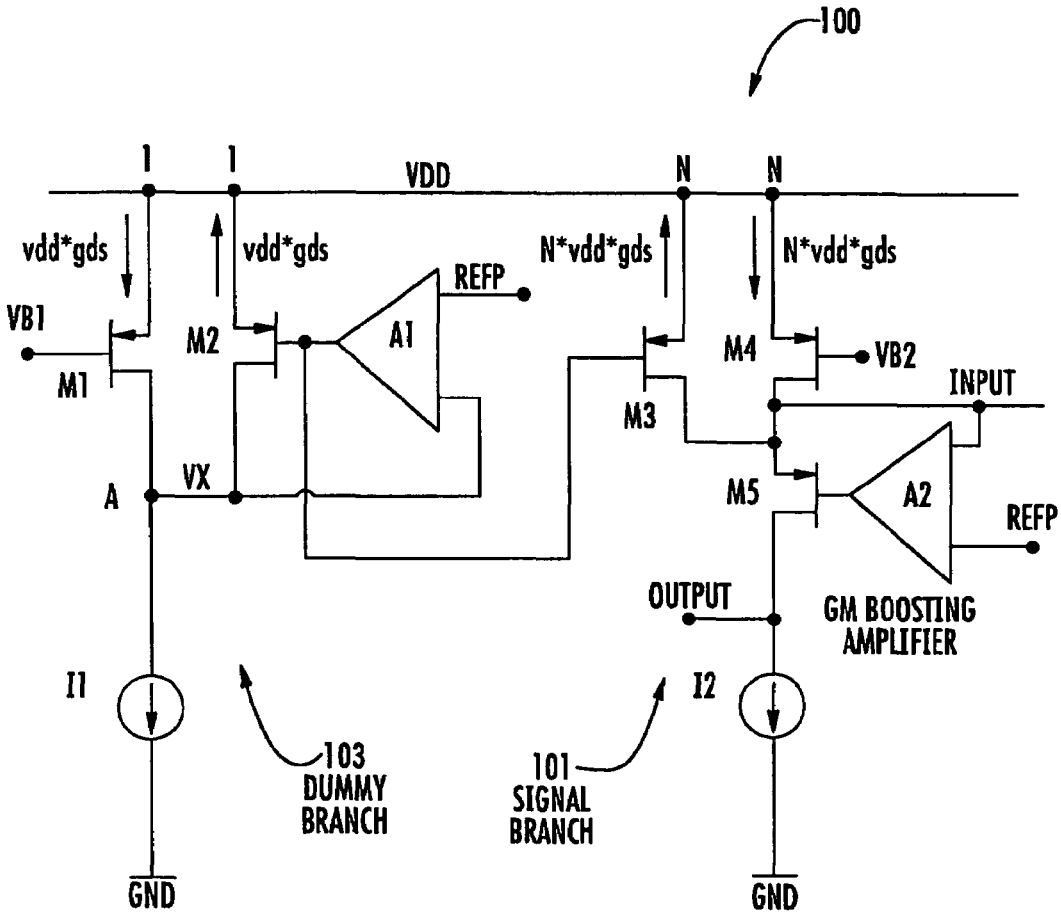
FIG.

ACTIVE POWER SUPPLY REJECTION USING NEGATIVE CURRENT GENERATION LOOP FEEDBACK

CROSS-REFERENCE TO RELATED APPLICATIONS

This application claims the benefit of U.S. Provisional Application No. 60/614,636 filed on Sep. 30, 2004, which is herein incorporated by reference for all intents and purposes.

BACKGROUND OF THE INVENTION

1. Field of the Invention

The present invention relates to power supply rejection, and more particularly to active power supply rejection using negative current generation loop feedback to reduce power supply noise injected into the signal path of amplifiers, filters, reference circuits and the like.

2. Description of the Related Art

The performance and function of many electronic circuits, including amplifiers (particularly open-loop amplifiers), filters, reference circuits, etc., are affected by the stability of the voltage of the power supply. The measure of performance is known as the power supply rejection (PSR). There is an increasing demand to have high rejection of power supply noise in analog and/or digital systems, particularly in communication applications.

Many analog and/or digital applications employ a P-channel metal-oxide semiconductor (PMOS) common gate (CG) amplifier for buffering or amplifying a signal. In this configuration, PMOS current source transistors provide the primary paths for coupling power supply noise to the signal. When biased using a diode-connected mirror transistor and a current source with adequate output resistance, the gate voltage of the PMOS current source transistor tracks the power supply noise. Hence, the power supply noise coupling occurs predominantly through source/bulk voltage fluctuations. The current follows the output conductance "gds" and the bulk-to-drain capacitance (Cbd) and gate-to-drain capacitance (Cgd) paths.

It is desired to counteract power supply noise to improve power supply rejection.

SUMMARY OF THE PRESENT INVENTION

A negative current generator for an amplifier circuit according to an embodiment of the present invention includes a shunt transistor, first and second mirror transistors, a current bias device, and an amplifier. The amplifier circuit includes a current source transistor having a first current terminal coupled to a first supply terminal, a control terminal receiving a first bias voltage and a second current terminal coupled to an input node. The shunt transistor has first and second current terminals for coupling to the first and second current terminals, respectively, of the current source transistor. Each of the first and second mirror transistors has a control terminal, a first current terminal coupled to the first supply terminal and a second terminal coupled to a voltage node. The control terminal of the first mirror transistor receives a second bias voltage. The current bias device is coupled between the voltage node and a second supply terminal and draws a constant current from the voltage node. The amplifier has a first input receiving a reference voltage, a second input coupled to the voltage node, and an output coupled to the control terminals of the shunt and second mirror transistors. The amplifier operates to drive the control terminal of the second mirror transistor to maintain the voltage node equal to the reference voltage.

The shunt transistor and the current source transistor may be equally sized, and the first and second mirror transistors may also be equally sized and scaled relative to the shunt transistor. In a more specific embodiment, the shunt transistor and the first and second mirror transistors may each be P-channel devices or PMOS transistors and the like. The first and second bias voltages may be equal to each other.

An amplifier circuit according to an embodiment of the present invention includes five P-channel devices, first and second bias current devices, and first and second amplifiers. The first P-channel device has first and second current electrodes coupled between a power supply voltage and a dummy node and has a control electrode receiving a first bias voltage. The second P-channel device has first and second current electrodes coupled between the power supply voltage and the dummy node and has a control electrode. The first bias current device is coupled between the dummy node and ground. The first amplifier has a first input receiving a reference voltage, a second input coupled to the dummy node, and an output coupled to the control electrode of the second P-channel device. The third P-channel device has first and second current electrodes coupled between the power supply voltage and an input node and has a control electrode coupled to the output of the first amplifier. The third P-channel device has a conductance that is N times that of the second P-channel device. The fourth P-channel device has first and second current electrodes coupled between the power supply voltage and the input node and has a control electrode receiving a second bias voltage. The fourth P-channel device has a conductance that is N times that of the first P-channel device. The fifth P-channel device has first and second current electrodes coupled between the input node and an output node and has a control electrode. The second bias current device is coupled between the output node and ground. The second amplifier has a first input coupled to the input node, a second input receiving the reference voltage, and an output coupled to the control electrode of the fifth P-channel device.

The P-channel devices may be PMOS transistors or the like. The first and second P-channel devices may be equal in size and the third and fourth P-channel devices may also be equal in size. The first and second P-channel devices may be scaled relative to the fourth and third P-channel devices, respectively. The first and second bias voltages may be equal to each other.

A method of rejecting power supply noise in an amplifier circuit according to an embodiment of the present invention, where the amplifier has a current source transistor with first and second current terminals coupled between a supply terminal and an input node, includes coupling first and second current terminals of a shunt transistor between the supply terminal and the input node, coupling first and second current terminals of a first mirror transistor between the supply terminal and a dummy node, coupling first and second current terminals of a second mirror transistor between the supply terminal and the dummy node, biasing the dummy node with a constant current device, and coupling an amplifier to drive control terminals of the second mirror transistor and the shunt transistor to maintain the dummy node at a predetermined reference voltage level.

The method may include coupling the control terminals of the current source and first mirror transistor to the same bias voltage level. The method may include scaling the first and second mirror transistors relative to the current source transistor and the shunt transistor, respectively, by the same scaling factor. The method may include coupling a source terminal of a PMOS transistor to the supply terminal and coupling a drain terminal of the PMOS transistor to the input node. The method may include coupling a source terminal of a PMOS transistor to the supply terminal and coupling a drain terminal of the PMOS transistor to the dummy node. The method may include coupling a source terminal of a PMOS transistor to the supply terminal and coupling a drain terminal of the PMOS transistor to the dummy node. The method may include coupling a constant current sink between the dummy node and a second supply terminal. The method may include coupling a first input of the amplifier to the predetermined reference voltage level, coupling a second input of the amplifier to the dummy node, and coupling an output of the amplifier to the control terminals of the second mirror transistor and the shunt transistor.

BRIEF DESCRIPTION OF THE DRAWINGS

The benefits, features, and advantages of the present invention will become better understood with regard to the following description, and accompanying drawing, in which:

The sole FIGURE is a schematic diagram of a PMOS common gate (CG) amplifier employing a negative current generation loop implemented according to an exemplary embodiment of the present invention.

DETAILED DESCRIPTION

The following description is presented to enable one of ordinary skill in the art to make and use the present invention as provided within the context of a particular application and its requirements. Various modifications to the preferred embodiment will, however, be apparent to one skilled in the art, and the general principles defined herein may be applied to other embodiments. Therefore, the present invention is not intended to be limited to the particular embodiments shown and described herein, but is to be accorded the widest scope consistent with the principles and novel features herein disclosed.

The inventor has recognized the need to reduce the power supply noise injected into the signal path in various electronic circuits, such as filters, amplifiers, reference circuits, etc. He has therefore developed a negative current generation loop that uses a shunt current source to inject negative current noise to minimize power supply noise in the signal path.

The sole FIGURE is a schematic diagram of a P-channel metal-oxide semiconductor (PMOS) common gate (CG) amplifier 100 employing a negative current generation loop implemented according to an exemplary embodiment of the present invention. A supply voltage VDD is provided to the sources of PMOS transistors M1, M2, M3 and M4. The gate of M4 receives a bias voltage VB2, and its drain is coupled to an input node INPUT. The input node INPUT is also coupled to the drain of M3, to a first input of a transconductance (gm) boosting amplifier A2, and to the source of another PMOS transistor M5. The drain of M5 forms an OUTPUT node, which is coupled to an input of a bias current source I2 having its output coupled to ground (GND). The current source I2 generates a current 12 from the OUTPUT node to GND. The second input of the amplifier A2 receives a reference voltage REFP.

An amplifier A1 receives the REFP voltage at a first input and has its second input coupled to a node A, which develops a voltage VX. The output of A1 is coupled to the gates of M2 and M3. The drains of M1 and M2 are coupled to node A, which is coupled to the input of another bias current source I1 having its output coupled to GND. The current source I1 generates a current I1 from node A to GND. The gate of M1 receives a bias voltage VB1, where VB1 is related to VB2 in the illustrated embodiment. For example, VB2=VB1, or they are related by a suitable factor, or they may, in fact, be the same bias node. M1 and M2 are "mirror" transistors of M4 and M3, respectively. In particular, M1 is scaled relative to M4 by a factor "N" and has its drain-source path coupled between VDD and node A similar to the drain-source path of transistor M4 coupled between VDD and INPUT. M2 is scaled relative to M3 by the same factor N and has its drain-source path coupled in parallel with the drain-source path of M1 similar to the drain-source path of M3 coupled in parallel with the drain-source path of M4. Also, the gates of M2 and M3 are driven by the output of the amplifier A1. The transistors M3, M4 and M5, the amplifier A2 and the current source I2 collectively form a signal branch 101. The transistors M1 and M2, the amplifier A1 and the current source I1 collectively form a "dummy" branch 103 providing a negative current generation loop that senses and compensates for power supply noise.

M3 and M4 are signal path current source transistors for M5. M4 is biased from a diode-connected PMOS bias transistor (not shown) providing the bias voltage VB2. M3 is a shunt current source driven by the output of the amplifier A1, where the amplifier A1 is part of a negative current generation loop. The amplifier A1, having a sufficiently high gain to drive its inputs to be relatively equal, senses the voltage VX at node A and drives the gate of M2 to maintain VX at REFP, while also driving the gate of M3. In this configuration, the PMOS current source transistors are the major source of power supply noise coupling path. When biased using a diode-connected mirror transistor and a current source with adequate output resistance, the gate voltage of the PMOS current source transistor M4 tracks the noise of the power supply VDD. Hence, the power supply noise coupling occurs predominantly through source/bulk voltage fluctuations. The current follows an output conductance "gds" and the bulk-to-drain capacitance (Cbd) and gate-to-drain capacitance (Cgd) paths.

If vdd represents the small signal power supply perturbations of the source voltage VDD, then variations in VDD cause a noise component current N*vdd*gds to flow via the source-drain path of M4 from VDD to INPUT (where the asterisk "*" denotes multiplication). It is noted that the output conductance "gds" in this case represents the combined conductance of the mirror components M1 and M2, where the combined conductance of M3 and M4 is N*gds. It is desired to control the gate of M3 such that it generates an equal and opposite compensation current N*vdd*gds through the drain-source path of M3 from the INPUT node to VDD for compensation to minimize the effect of the power supply noise. In other words, the potential noise caused in the signal path by injecting the noise component current N*vdd*gds into the node INPUT is essentially canceled by pulling or drawing out the same level of current from node INPUT to VDD via M3 to significantly reduce noise.

The same variation in VDD causing the noise component current N*vdd*gds flowing into the source of M4 causes a similar noise component current vdd*gds into the source of M1. The noise component current vdd*gds effectively flows into node A causing a corresponding change of VX. The amplifier A1 counteracts the change of VX by controlling the gate of M2 to generate an equal and opposite compensation current vdd*gds flowing through the drain-source path of M2 from node A to VDD. The amount of compensation applied to the gate of M2 to generate the compensation current vdd*gds through M2 is the same compensation applied to the gate of M3 to generate the compensation current N*vdd*gds through M3. In summary, the dummy branch 103 controls M2 to pull back the supply noise injected by the gds components of M1 and M2, and, due to the mirroring effect of M1 and M2 relative to M3 and M4, also controls M3 to pull back the supply noise injected in the signal path by the gds components of M3 and M4.

For low frequency analysis, let gds1, gds2, gds3 and gds4 be the output conductances of M1, M2, M3 and M4, respectively, let gm2 and gm3 be the transconductance factors of M2 and M3, respectively, and let A be the DC gain of the amplifier A1. Also, let "vx" be the small signal noise perturbations of VX at node A caused by vdd, which is the small signal supply perturbation of VDD. Supply noise injected into the signal path, without negative current compensation injection, is given by vdd*(gds3+gds4). The current components in the dummy branch 103 are as follows: a first current component (vdd−vx)*(gds1+gds2) due to the gds components of M1 and M2; a second component gm2*A*vx due to the voltage controlled current source component of M2; and an output resistance component R0 of the current source I1. It is shown that the gm2*A*vx current component is equal to and opposite of the gds components of M1 and M2 except for a leakage current due to the finite output resistance R0 of the current source I1. The leakage current, however, is A*gm2*R0 times smaller than the original gds components, and thus is very small. Neglecting the small leakage current (which sets the theoretical limit for PSR ratio enhancement), the gds current component is "pulled back" by the negative feedback loop formed by the amplifier A1 and the M2 transistor. Intuitively, the transistor M2 serves to pull back the supply noise injected by the gds components of M1 and M2, and, due to mirroring effect of M1/M2 with M3/M4, the gm3 current component of M3 cancels the gds3+gds4 current components of M3 and M4.

The factor N may be any value including 1 for a 1:1 correspondence between M1 and M2 relative to M3 and M4, respectively. A factor of N greater than one allows the use of significantly smaller transistors M1 and M2 in the dummy branch 103 to improve efficiency and to reduce overall size of the PMOS CG amplifier 100. For example, the size of the transistors M1 and M2 can be made appreciably smaller and thus draw appreciably less current to achieve similar results.

In experimental results, cancellation of power supply noise was observed in a PMOS common gate amplifier with a negative current generation loop implemented according to an embodiment of the present invention used in a microphone amplifier. The PSR ratio (PSRR) at 217 Hertz (Hz) was improved from 30 decibels (dB) to 85 dB.

Although the present invention has been described in considerable detail with reference to certain preferred versions thereof, other versions and variations are possible and contemplated. For example, the same principles may be applied to differential pairs or other amplifiers using PMOS current source transistors. Those skilled in the art should appreciate that they can readily use the disclosed conception and specific embodiments as a basis for designing or modifying other structures for providing out the same purposes of the present invention without departing from the spirit and scope of the invention as defined by the appended claims.

What is claimed is:

1. A negative current generator for an amplifier circuit, the amplifier circuit including a current source transistor having a first current terminal coupled to a first supply terminal, a control terminal receiving a first bias voltage and a second current terminal coupled to an input node, said negative current generator comprising:

a shunt transistor having a control terminal and having first and second current terminals for coupling to the first and second current terminals, respectively, of the current source transistor;

first and second mirror transistors, each having a control terminal, a first current terminal coupled to the first supply terminal and a second terminal coupled to a voltage node, wherein said control terminal of said first mirror transistor receives a second bias voltage;

a current bias device, coupled between said voltage node and a second supply terminal, that draws a constant current from said voltage node; and an amplifier having a first input receiving a reference voltage, a second input coupled to said voltage node, and an output coupled to said control terminals of said shunt and second mirror transistors.

2. The negative current generator of claim 1, wherein said shunt transistor and the current source transistor are equally sized, and wherein said first and second mirror transistors are equally sized and scaled relative to said shunt transistor.

3. The negative current generator of claim 1, wherein said shunt transistor and said first and second mirror transistors each comprise P-channel devices.

4. The negative current generator of claim 1, wherein said shunt transistor and said first and second mirror transistors each comprise PMOS transistors.

5. The negative current generator of claim 1, wherein said amplifier operates to drive said control terminal of said second mirror transistor to maintain said voltage node equal to said reference voltage.

6. The negative current generator of claim 1, wherein said second bias voltage is equal to the first bias voltage.

7. An amplifier circuit, comprising:

a first P-channel device, having first and second current electrodes coupled between a power supply voltage and a dummy node and a control electrode receiving a first bias voltage;

a second P-channel device, having first and second current electrodes coupled between said power supply voltage and said dummy node and a control electrode;

a first bias current device coupled between said dummy node and ground;

a first amplifier having a first input receiving a reference voltage, a second input coupled to said dummy node, and an output coupled to said control electrode of said second P-channel device;

a third P-channel device, having first and second current electrodes coupled between said power supply voltage and an input node and having a control electrode coupled to said output of said first amplifier, said third P-channel device having a conductance that is N times that of said second P-channel device;

a fourth P-channel device, having first and second current electrodes coupled between said power supply voltage and said input node and has a control electrode receiving a second bias voltage, said fourth P-channel device having a conductance that is N times that of said first P-channel device;

a fifth P-channel device, having first and second current electrodes coupled between said input node and an output node and has a control electrode;

a second bias current device coupled between said output node and ground; and a second amplifier having a first input coupled to said input node, a second input receiving said reference voltage, and an output coupled to said control electrode of said fifth P-channel device.

8. The amplifier circuit of claim 7, wherein said first, second, third, fourth and fifth P-channel devices each comprise a PMOS transistor.

9. The amplifier circuit of claim 7, wherein said first and second P-channel devices are equal in size and wherein said third and fourth P-channel devices are equal in size.

10. The amplifier circuit of claim 9, wherein said first and second P-channel devices are scaled relative to said fourth and third P-channel devices, respectively.

11. The amplifier circuit of claim 7, wherein said first and second bias voltages are equal.

12. A method of rejecting power supply noise in an amplifier circuit which has a current source transistor with first and second current terminals coupled between a supply terminal and an input node, said method comprising:

coupling first and second current terminals of a shunt transistor between the supply terminal and the input node;

coupling first and second current terminals of a first mirror transistor between the supply terminal and a dummy node;

coupling first and second current terminals of a second mirror transistor between the supply terminal and the dummy node;

biasing the dummy node with a constant current device; and coupling an amplifier to drive control terminals of the second mirror transistor and the shunt transistor to maintain the dummy node at a predetermined reference voltage level.

13. The method of claim 12, further comprising coupling the control terminals of the current source and first mirror transistor to the same bias voltage level.

14. The method of claim 12, further comprising scaling the first and second mirror transistors relative to the current source transistor and the shunt transistor, respectively, by the same scaling factor.

15. The method of claim 12, wherein said coupling first and second current terminals of a shunt transistor between the supply terminal and the input node comprises coupling a source terminal of a PMOS transistor to the supply terminal and coupling a drain terminal of the PMOS transistor to the input node.

16. The method of claim 12, wherein said coupling first and second current terminals of a first mirror transistor between the supply terminal and a dummy node comprises coupling a source terminal of a PMOS transistor to the supply terminal and coupling a drain terminal of the PMOS transistor to the dummy node.

17. The method of claim 12, wherein said coupling first and second current terminals of a second mirror transistor between the supply terminal and the dummy node comprises coupling a source terminal of a PMOS transistor to the supply terminal and coupling a drain terminal of the PMOS transistor to the dummy node.

18. The method of claim 12, wherein said biasing the dummy node with a constant current device comprises coupling a constant current sink between the dummy node and a second supply terminal.

19. The method of claim 12, wherein said coupling an amplifier to drive control terminals of the second mirror transistor and the shunt transistor to maintain the dummy node at a predetermined reference voltage level comprises:

coupling a first input of the amplifier to the predetermined reference voltage level;

coupling a second input of the amplifier to the dummy node; and coupling an output of the amplifier to the control terminals of the second mirror transistor and the shunt transistor.

* * * * *